United States Patent [19]

Taylor

[11] Patent Number: 4,489,965

[45] Date of Patent: Dec. 25, 1984

[54] SLIDING WINDOW LATCH

[75] Inventor: Philip E. Taylor, Bloomfield Hills, Mich.

[73] Assignee: General Motors Corporation, Detroit, Mich.

[21] Appl. No.: 443,380

[22] Filed: Nov. 22, 1982

[51] Int. Cl.[3] ..... E05C 1/12; E05C 7/00

[52] U.S. Cl. ..... 292/34; 292/147; 292/DIG. 46; 49/449

[58] Field of Search ..... 292/34, 170, 147, 342, 292/DIG. 46; 49/413, 449–451

[56] References Cited

U.S. PATENT DOCUMENTS

| | | | |
|---|---|---|---|
| 2,685,110 | 8/1954 | Hauck | 292/DIG. 46 |
| 3,009,215 | 11/1961 | Fraleigh | 49/413 X |
| 3,083,045 | 3/1963 | Linderoth | 49/413 X |
| 3,383,801 | 5/1968 | Dallaire | 49/413 X |
| 3,827,184 | 8/1974 | Pennec et al. | 49/449 |
| 4,202,136 | 5/1980 | Riegelman | 49/449 |
| 4,233,781 | 11/1980 | Roe | 49/413 X |

*Primary Examiner*—Alexander Grosz
*Assistant Examiner*—Thomas J. Dubnicka
*Attorney, Agent, or Firm*—Patrick M. Griffin

[57] ABSTRACT

A latching mechanism for a pair of relatively slidable overlapping window panels includes a pair of opposed fixed support blocks with bearing surfaces engageable with the outside surfaces of the window panels. A first wedging block is floatingly mounted between the window panels and has a bearing surface engageable with the inside surface of one window panel and a slanted wedging surface spaced from the inside surface of the other window panel. A latching lever, movable between operative and inoperative positions, is secured to a second wedging block which has a wedging surface engageable with the wedging surface of the first wedging block and a bearing surface engageable with the inside surface of the other window panel. In the operative position of the lever, the engagement of the wedging surfaces of the wedging blocks engages the bearing surfaces of the wedging blocks with the inside surfaces of respective window panels to wedge the panels against the bearing surfaces of the support blocks. When the lever is rotated to inoperative position, the second wedging block is moved out of engagement with the first wedging block, to allow the window panels to slide freely relative to each other.

2 Claims, 2 Drawing Figures

SLIDING WINDOW LATCH

This invention relates to latches and specifically to a latching mechanism latching a pair of sliding window panels relative to one another in an infinite number of positions.

BACKGROUND OF THE INVENTION

Sliding windows of the type including a pair of parallel planar window panels slidably supported for sliding movement past one another are sometimes found in the interior of vehicles, for example, cabs or limousines, and are generally known as privacy partitions. It is desirable to latch these panels relative to one another at an infinite number of relative positions, if possible. A latch for this type of sliding window is disclosed in the patent to Pennec et al U.S. Pat. No. 3,827,184. As disclosed, however, the latch maintains the windows relative to one another in only one closed position.

SUMMARY OF THE INVENTION

The present invention provides a latching mechanism in which a sliding window of the described type may be latched in an infinite number of positions. The window includes a pair of planar window panels slidably supported parallel to one another in a pair of conventional horizontal slideways or tracks such that the two adjacent inner vertical edges of the panels overlap. A mounting plate attached to the vehicle is located beneath the window panels at the point where they overlap. Two opposed support blocks are fixed to the mounting plate, each of which has a bearing surface held in sliding engagement with the outside surface of one of the panels at the overlap. Between the window panels, and also at the point of overlap, is a floating wedging block with a bearing surface engageable with the inside surface of one of the window panels and a wedging surface respective to and spaced from the inside surface of the other window panel. The floating wedging block is attached to the mounting plate by a pin through an elongated hole therein so that it may float with its bearing surface moving into and out of engagement with the one window panel. A locking lever is pivotally joined beneath the mounting plate and has a pin thereon which extends up through an arcuate slot in the mounting plate. A second wedging block having a bearing surface and a wedging surface is attached to the pin on the locking lever.

The locking lever moves the second wedging block into an operative position where its bearing surface engages the inside surface of the other window panel and its wedging surface engages the wedging surface of the floating wedging block. This biases the window panels outwardly into the support blocks to hold the window panels in latched position. As the locking lever is moved to an inoperative position, the second wedging block moves away from the first which floats out of engagement with the one window panel. The window panels may then slide freely relative to one another in the track.

It is the object of the invention, therefore, to provide a latching mechanism for overlapping sliding window panels which gives an infinite number of latched positions.

BRIEF DESCRIPTION OF THE DRAWINGS

This object and other features of the invention will appear from the following written description and the accompanying drawings in which.

DESCRIPTION OF THE PREFERRED EMBODIMENT

Figure 1:
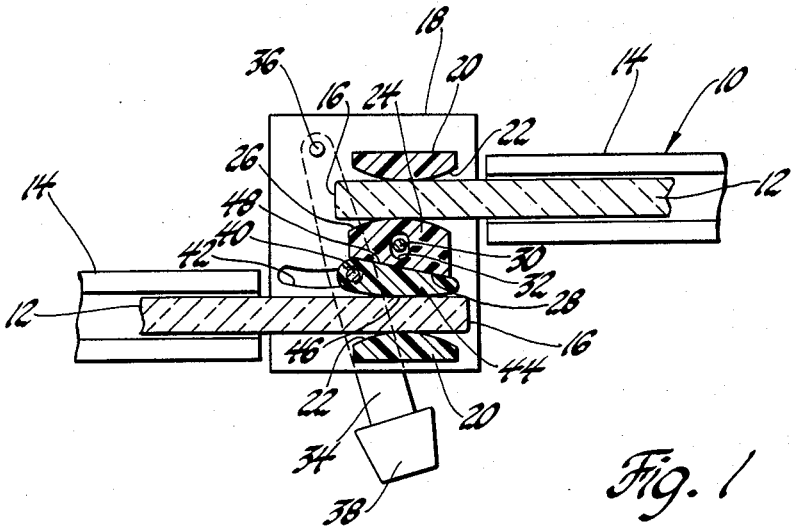
FIG. 1 is a view of the latching mechanism in operative position.

Referring first to FIG. 1, a sliding window designated generally at 10 includes a pair of generally rectangular planar window panels 12 which are slidably supported in a conventional manner in a pair of parallel slideways or track members 14. Window panels 12 overlap at adjacent inside edges 16 thereof. In a conventional application, such as a privacy partition between the driver's and passenger's seat, the slideways 14 would be horizontal and the adjacent overlapping edges 16 would be vertical. For the broadest application, however, all that is important is that the panels 12 do overlap and that at least one slides past the other.

Figure 2:
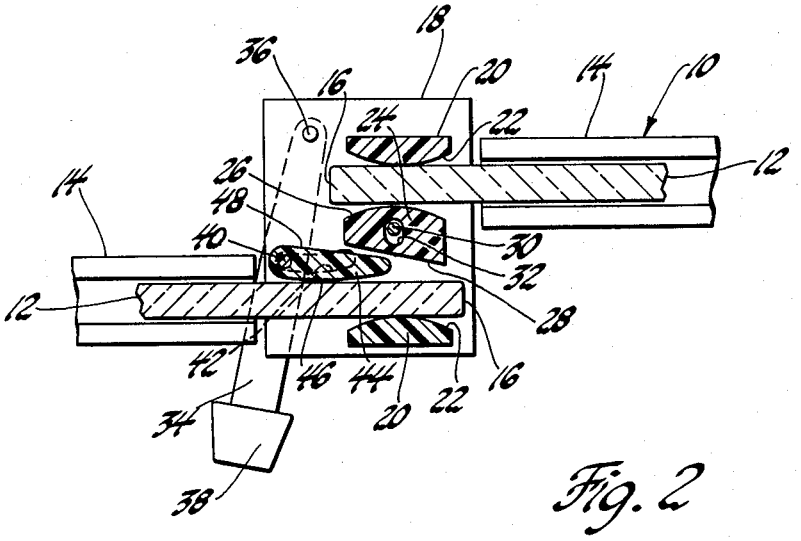
FIG. 2 is a view of the latching mechanism in inoperative position.

The latch mechanism of the invention is located at the overlap of panels 12. The elements thereof are attached to a mounting member or plate 18 which is rigidly attached relative to the vehicle and the track members 14 by any suitable means. A mounting member 18 is located above or below panels 12 or to both sides thereof so that one or both panels 12 slide relative thereto. Attached to and extending upwardly from mounting plate 18 substantially perpendicularly thereto is a pair of opposed support blocks 20. Blocks 20 are formed of nylon or some other suitable material and each has a curved bearing surface 22 which is engaged by the outside surface of a respective one of the panels 12 at the overlap thereof. This creates a slight rubbing friction as panels 12 slide back and forth but it is light enough to not interfere with that sliding motion. Also attached to mounting member 18 is a first floating wedging block 24 formed of a similar material and having a first curved bearing surface 26 which is respective to and engageable with the inside surface of one window panel 12 and a second planar wedging surface 28, best seen in FIG. 2, which is spaced from and respective to the inside surface of the other window panel 12. In the embodiment disclosed, wedging surface 28 is vertically slanted. A pin 30 is rigidly joined to plate 18 and received within an elongated aperture 32 through the center of block 24. This allows block 24 to float in and out of engagement with the one panel 12 for a purpose to be described below. Other means may be envisioned for mounting block 24 which will allow it to move in identical fashion, but the means disclosed is simple and effective.

Also mounted to plate 18 is a latching lever 34 which is pivoted by a pin 36 beneath plate 18 so that it may be pivoted back and forth substantially parallel thereto without contacting window panels 12, support blocks 20, or wedging block 24. Lever 34 has a grippable knob 38 which allows an operator to move it back and forth between an operative position seen in FIG. 1, and an inoperative position seen in FIG. 2. Attached to lever 34 near its center is a pin 40 which extends up through an arcuate closed slot 42 in plate 18 and is attached to a second wedging block 44 made of nylon or similar material. Block 44 has a curved bearing surface 46 engageable with the inside surface of the other window panel 12 and a planar vertically slanted wedging surface 48 engageable with the wedging surface 28 of first wedging block 24. The mounting of second wedging block 44 to pin 40 is snug, but does allow for some slight rotation.

In the operative position of latch lever 34 shown in FIG. 1, the planar slanted wedging surfaces 28 and 48 of the first and second wedging blocks 24 and 44 are wedged together between the panels 12 at the overlap thereof. This engages the bearing surfaces 26 and 46 thereof with the inside surfaces of respective panels 12 and in turn forces the outside surfaces of panels 12 into the bearing surfaces 22 of support blocks 20. Thus, panels 12 are rigidly but releasably held relative to one another in a latched position. When lever 34 is moved to the inoperative position of FIG. 2, the wedging force of block 44 against block 24 is removed, and the one panel 12 may slide easily past the floating first wedging block 24, which can move on its pin 30, and the other panel 12 slides easily past the bearing surface 46 of second wedging block 44, which may rotate slightly about its pin 40. Both panels 12 also slide past a surface 22 of a respective block 20. It will be apparent that panels 12 may be latched relative to one another in an infinite number of overlapped positions.

The embodiments of the invention in which an exclusive property or privilege is claimed are defined as follows:

1. A latching mechanism for latching a pair of relatively slidable overlapping window panels, either one of which is slidable, to each other at an infinite number of relative positions, comprising, a mounting member, a pair of opposed support blocks fixed to the mounting member, each block having a bearing surface engageable with the outside surface of a respective window panel at the overlap thereof, a first wedging block located between the opposed support blocks, said first wedging block having a bearing surface engageable with the inside surface of one window panel opposite one support block and a wedging surface spaced from the inside surface of the other window panel, means floatingly mounting the first wedging block to the mounting member to allow its bearing surface to be moved freely into and out of engagement with the inside surface of the one window panel, a second wedging block located in the space between said first wedging block and said other window panel including a bearing surface engageable with the inside surface of the other window panel opposite the other support block and a wedging surface engageable with the wedging surface of the first wedging block, and means for moving the second wedging block at any relative position of said window panels between an operative position wedged between the first wedging block and the inside surface of the other window panel to bias the bearing surfaces of the wedging blocks into the inside surfaces of the window panels to in turn force the outside surfaces of the window panels into the bearing surfaces of the support blocks and latch the window panels in an infinite number of overlap positions and an inoperative position free of wedging engagement with the first wedging block, said means floatingly mounting said first wedging block allowing the bearing surface of said wedging block to be moved away from the inside surface of said one window panel to free the window panels for relative sliding movement.

2. A latching mechanism for latching a pair of relatively slidable overlapping window panels, either one of which is slidable, at an infinite number of relative positions, comprising, a mounting member, a pair of opposed support blocks fixedly attached to the mounting member, each block having a bearing surface engageable with the outside surface of a respective window panel at the overlap thereof, a first wedging block having a bearing surface and a wedging surface, means floatingly mounting said first wedging block to the mounting member between the opposed support blocks, with said bearing surface respective to the inside surface of one window panel and with a space between said wedging surface and the inside surface of the other window panel, said mounting means allowing said bearing surface to be moved freely into and out of engagement with the inside surface of said one window panel, a latching member movable relative to the mounting member between an operative position toward said space and an inoperative position away from said space, a second wedging block mounted to said latching member, said second wedging block having a wedging surface engageable with the wedging surface of said first wedging block and a bearing surface engageable with the inside surface of said other window panel, moving said latching member to said operative position at any relative position of said window panels moving said second wedging block into said space to engage the bearing surface of said second wedging block with the inside surface of said other window panel and wedgingly engaging the wedging surfaces of said first and second wedging blocks to in turn move the floatingly mounted first wedging block to engage its bearing surface with the inside surface of said one window panel and bias the window panels outwardly into engagement with the bearing surfaces of said fixed support blocks to latch said window panels, moving said latching lever to said inoperative position moving said second wedging block out of said space to allow said first wedging block to float out of engagement with the inside surface of said one window panel to allow said window panels to slide freely relative to another relative position.

* * * * *